US005347109A

United States Patent [19]

Nakabayashi et al.

[11] Patent Number: 5,347,109

[45] Date of Patent: Sep. 13, 1994

[54] HIGH-FREQUENCY HEATING APPARATUS MOUNTED ON A MOTOR VEHICLE

[75] Inventors: Yuji Nakabayashi; Naoyoshi Maehara; Daisuke Bessyo; Takahiro Matsumoto, all of Nara, Japan

[73] Assignee: Matsushita Electric Industrial Co., Ltd., Osaka, Japan

[21] Appl. No.: 842,146

[22] PCT Filed: Jul. 25, 1991

[86] PCT No.: PCT/JP91/00998

§ 371 Date: Mar. 20, 1992

§ 102(e) Date: Mar. 20, 1992

[87] PCT Pub. No.: WO92/02111

PCT Pub. Date: Feb. 6, 1992

[30] Foreign Application Priority Data

Jul. 25, 1990 [JP] Japan ..... 2-197250
Nov. 30, 1990 [JP] Japan ..... 2-338177

[51] Int. Cl.[5] ..... H05B 6/68

[52] U.S. Cl. ..... 219/716; 219/723; 219/756; 219/762

[58] Field of Search ..... 219/10.55 B, 10.55 E, 219/10.55 R, 10.55 D, 10.55 C, 715, 716, 704, 762, 763, 723, 756, 717

[56] References Cited

U.S. PATENT DOCUMENTS 4,131,786 12/1978 Cooper ..... 219/10.55 B
4,481,395 11/1984 Smith et al. ..... 219/10.55 E
4,667,075 5/1987 Sakurai ..... 219/10.55 B
4,777,575 10/1988 Yamato et al. ..... 219/10.55 B
4,816,635 3/1989 Edamura ..... 219/10.55 B
4,900,885 2/1990 Inumada ..... 219/10.55 B
4,904,837 2/1990 Low et al. ..... 219/10.55 B

FOREIGN PATENT DOCUMENTS

0171170A3 12/1986 European Pat. Off. .
0280100A1 8/1988 European Pat. Off. .
62-69486 3/1987 Japan .
63-195991 8/1988 Japan .
1305233 8/1989 Japan .
1-305234 12/1989 Japan .
1-313884 12/1989 Japan .
2-29512 1/1990 Japan .
2-97827 4/1990 Japan .

*Primary Examiner*—Philip H. Leung
*Attorney, Agent, or Firm*—Wenderoth, Lind & Ponack

[57] ABSTRACT

A DC power source constituted by a power generator (20), a dynamo (22) and a rectification means (23), an inverter power source (24) which boosts an output of the DC power source so as to drive a magnetron (28) and an inverter controller for controlling the inverter power source (24) by an output of a generated electric power output detecting means (31) for detecting the output of the DC power source are provided, whereby a required dielectric heating function can be stably achieved by controlling an operational state of the inverter power source (24) by the output of the DC power source.

18 Claims, 18 Drawing Sheets

HIGH-FREQUENCY HEATING APPARATUS MOUNTED ON A MOTOR VEHICLE

TECHNICAL FIELD

The present invention relates to an electronic range for heating foods, liquid, etc., a heat processing machine for heat processing wastes or a high-frequency heating apparatus for heating catalysts, etc., which are mounted on a mobile means such as a motor vehicle, a ship or the like.

BACKGROUND OF THE INVENTION

Conventionally, in substitution for the high-frequency heating apparatus of this kind represented by electronic ranges, a so-called electronic range for general home use adapted to employ a commercial power source has been used in combination with an AC dynamo for exclusive use having a predetermined frequency and a predetermined AC voltage.

FIG. 22 is a view showing an arrangement of a prior art high-frequency heating apparatus. This is a drawing in which the high-heating apparatus is used in a sightseeing bus or the like. In FIG. 22, an engine 2 for generating transport power is provided in a car body 1 and the transport power is transmitted to tires 3 so as to transport passengers.

A so-called electronic range 5 is mounted in such a car body so as to perform microwave heating of a food 4. This electronic range 5 is constituted by a power source device 9 including a ferro-resonance type boosting transformer 6, a resonance capacitor 7 and a high-voltage diode 8, a magnetron 10 and an oven 11 and can be used by connecting a commercial power source for home use to terminals 12 and 13. Thus, in order to cause the electronic range 5 to exhibit normal functioning, it is essential to supply a predetermined voltage of, for example, 100 V to the terminals 12 and 13 at a predetermined frequency of, for example, 60 Hz.

Therefore, conventionally, by using an AC voltage generator 16 provided with a power generator 14 for exclusive use and a dynamo 15 actuated by the power generator 14, a microwave heating apparatus having an arrangement as shown is achieved by this AC voltage generator 16 and the electronic range 5 for home use and has been used in the motor vehicle.

On the other hand, due to the widespread of motor available, vehicles in recent years, long-distance transport, long-distance drive or outdoor leisures such as yachting, camping, etc. have become popular and thus, a demand has increased for drinking and eating at locations having no commercial power source, for example, in a motor vehicle.

Meanwhile, especially, in order to improve performance of catalysts for purifying exhaust gas of engines such as a diesel engine, a need for use of microwave heating has arisen.

Thus, the need for a high-frequency heating apparatus usable easily especially at locations having no commercial power source has increased.

However, based on the prior art described above, it was difficult to sufficiently meet increasing demand for use of high-frequency heating apparatuses at locations having no commercial power source. Namely, in the prior art, a special AC stabilizing power source capable of ensuring stability of frequency and voltage equivalent to those of the commercial power source is necessary and thus, a high precision AC stabilizing power source for exclusive use was absolutely necessary. This is because the ferro-resonance type transformer is employed in the power source device for driving the magnetron so as to stabilize the operation and output of the magnetron through its resonance with the resonance capacitor.

Therefore, the prior art high-frequency heating apparatus is very large, heavy and expensive due to the necessity of the AC stabilizing power source, ferro-resonance transformer, etc. and is difficult to handle due to its poor controllability. Especially, employment of the ferro-resonance type transformer means necessity of the AC stabilizing power source for exclusive use and thus, it was impossible to avoid the above mentioned inconveniences.

Therefore, it was difficult to manufacture at low cost, a high-frequency heating apparatus which is easily usable at locations where it is difficult to obtain a commercial power source, such as in a mobile space of a motor vehicle, a yacht, etc.

DISCLOSURE OF THE INVENTION

Accordingly, objects of the present invention are to satisfy increasing demand for a high-frequency heating apparatus in which not only a high-voltage power can be easily supplied to a magnetron even if a DC power source mounted on a transport means of human beings, objects, animals, etc. and having poor accuracy in output stability is used but also necessary stable dielectric heating function can be easily achieved even at locations where it is difficult to obtain a commercial power source and to improve reliability, improve safety and provide comfortable operational performance.

To this end, a DC power source, an inverter power source for receiving DC power obtained from the DC power source, a magnetron which is actuated by output of the inverter power source, a DC output detecting means four detecting output of the DC power source directly or indirectly and an inverter controller for controlling operation of the inverter power source on the basis of a signal of the DC output detecting means are provided such that an operational state of the inverter power source is controlled in accordance with the magnitude of the DC output of the DC power source. Thus, even if a power generator and a dynamo, which are poor in accuracy of output stability and inexpensive due to their simple constructions, are employed, a required dielectric heating function can be stably achieved.

Meanwhile, a DC power source such as a cell, an inverter power source for receiving supply of electric power from the DC power source, an oscillator for driving a semiconductor switching element of the inverter power source, a control circuit for controlling the oscillator, an oscillator switch for turning on and off supply of electric power to the oscillator and a switching actuating means for turning on and off the oscillator switch by a signal of the control circuit are provided such that the inverter circuit is controlled in response to turning on and off of the oscillator switch for supplying necessary electric power to the oscillator. Thus, the oscillator switch, which is a relay switch for supplying necessary electric power to the oscillator, can be formed by a compact and inexpensive relay switch having a small contact capacity.

Furthermore, an apparatus body including a heating chamber for heating an article to be heated, a magnetron actuated by an inverter power source and an output controller for controlling output of the magnetron and an operating portion for giving an operating command to the output controller, which is detachable from the apparatus body are provided. Thus, the apparatus body can be installed at a position suitable for the apparatus and the operating portion can be operated at a location which is easiest to operate during running.

Moreover, an acceleration detecting means for detecting acceleration applied to the apparatus body and an acceleration control means which is actuated by output of the acceleration detecting means are provided. Thus, when the acceleration detecting means has detected acceleration applied to the apparatus body, for example, operation of the inverter power source is stopped, the power source of the control circuit is turned off or the door of the heating chamber is locked by the acceleration control means, whereby high-frequency heating can be safely performed even during displacement.

BEST MODE FOR WORKING THE INVENTION

Figure 1:
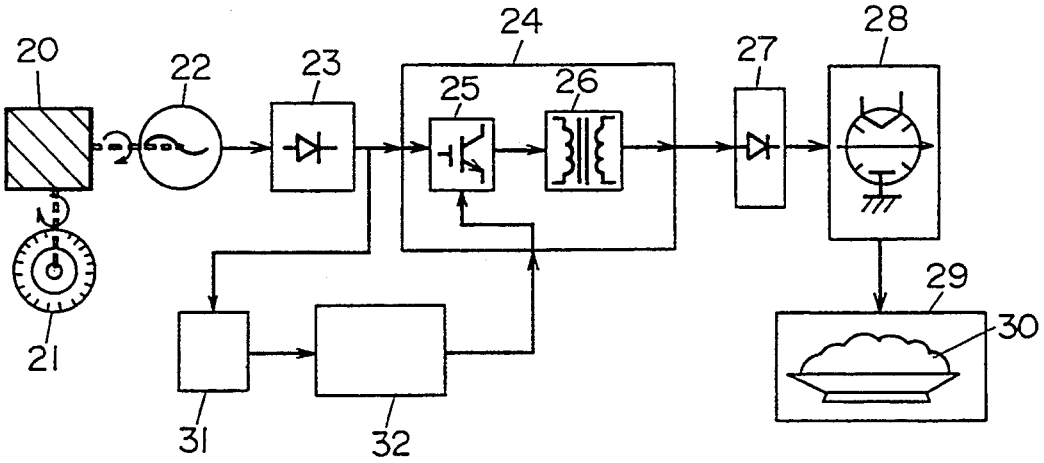
FIG. 1 is an overall block diagram of one embodiment of the present invention.

Hereinbelow, embodiments of the present invention are described together with the drawings. FIG. 1 is a block diagram showing a high-frequency heating apparatus of one embodiment of the present invention, which is applied to a motor vehicle.

In the drawing, a rotating power of an engine 20 acting as a power generator is arranged to be transmitted to tires 21 but, at the same time, also to an AC dynamo 22. An output voltage of the dynamo 22 is supplied to a rectification means 23. A DC output of this rectification means acts as a power source for supplying electric power to an inverter power source 24. This inverter power source 24 is constituted by a switching circuit 25 including a switching transistor and a resonance capacitor and a boosting transformer 26 serving also as a resonance inductor. A high-voltage output of this inverter power source is arranged to be supplied to a magnetron 28 through a rectifier 27. Output electromagnetic wave of the magnetron is supplied to a food 30 in an oven 29 such that dielectric heating of the food 30 can be performed.

Meanwhile, in order to stably control the number of rotations of the engine 20, it is necessary to perform sophisticated control of fuel supply and combustion state. In the case of the power generator 20 serving also as a transport power generator of the motor vehicle as in this embodiment, the number of rotations of the engine is forced to change greatly in accordance with the necessary number of rotations of the tires 21 corresponding to running speed of the motor vehicle. Therefore, output of the dynamo 22 changes greatly in accordance with the number of rotations of the power generator 20.

In order to not only perform excellent dielectric heating of the food 30 in such greatly changing operational state of the power generator 20 but prevent deterioration of reliability due to application of abnormal overload to the dynamo 22, operational state of the inverter power source 24, i.e. electric power conversion amount is required to be controlled in accordance with electric power generating capability in one form or another. To this end, a voltage detecting means (generated electric power output detecting means) 31 for detecting generated electric power of the dynamo 22 as output voltage of the rectification means 23 and an inverter controller 32 for controlling the switching circuit 25 of the inverter power source 24 in response to a signal of this voltage detecting means 31 are provided such that the inverter power source 24 is operated in accordance with magnitude of generated electric power output.

By such arrangement, however large variation range of the number of rotations of the power generator 20 may be, deterioration of reliability due to overload state does not occur and proper microwave heating of the food 30 can be achieved.

Figure 2:
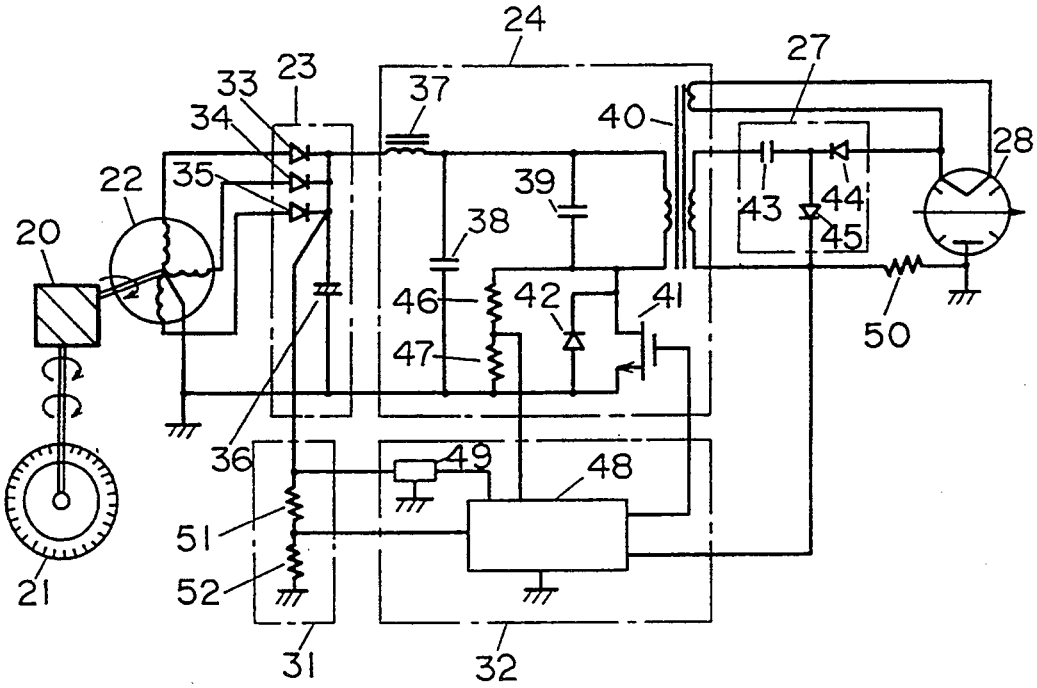
FIG. 2 is a circuit diagram of the high-frequency heating apparatus, FIGS. 3(*a*), 3(*b*) and 3(*c*) are operational waveform diagrams of an inverter of the high-frequency heating apparatus.

FIG. 2 is a circuit diagram showing a further detailed structure of the above mentioned embodiment of the present invention of FIG. 1. Numerals identical with those of FIG. 1 denote the corresponding constituent elements and detailed description thereof is abbreviated. An output of the dynamo 22 is rectified by the rectification circuit 23 constituted by diodes 33, 34 and 35 and a capacitor 36 so as to be converted into a DC voltage. This DC voltage is supplied to the inverter power source 24 constituted by an inductor 37, a by-pass condenser 38, a resonance capacitor 39, a boosting transformer 40, a transistor (IGBT) 41, a diode 42, etc. An output of the inverter power source 24 is supplied, as outputs of two secondary windings of the boosting transformer 40, to the magnetron 28. The output of the high-voltage secondary winding is converted into a high-voltage DC by the high-voltage rectification circuit 27 constituted by a capacitor 43 and diodes 44 and 45 and then, is supplied to the magnetron 28. On the other hand, the output of the low-voltage secondary winding is directly supplied to a cathode of the magnetron 28.

Figure 3:
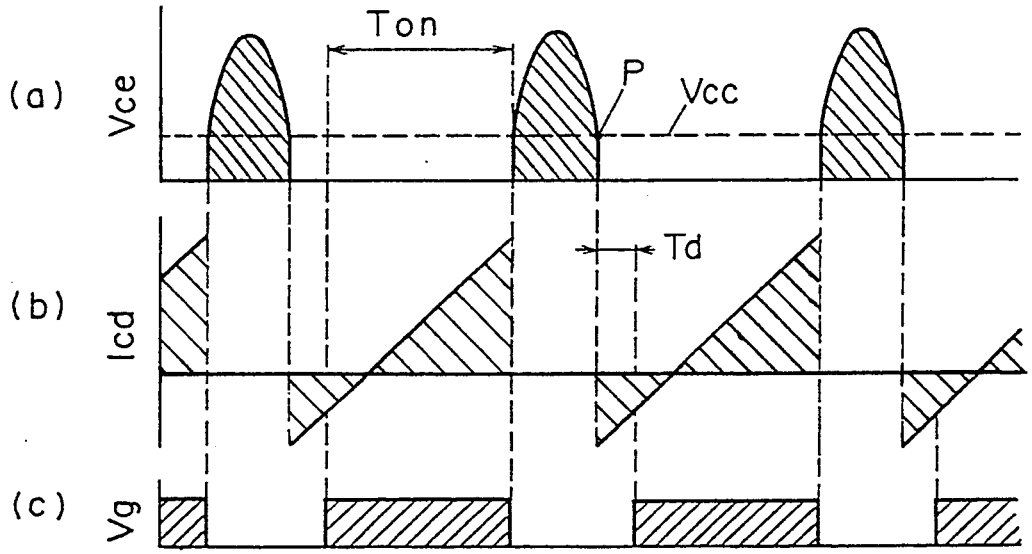

The inverter controller 32 mainly includes an inverter control circuit 48 which detects a collector voltage of the IGBT 41 as a synchronous signal by resistors 46 and 47 so as to control an energization period Ton of the IGBT 41 synchronously with resonance state of a resonance circuit constituted by the resonance capacitor 39 and the boosting transformer 40. FIGS. 3(*a*), 3(*b*) and 3(*c*) are wave-form diagrams of a collector voltage Vce, a collector current Icd and a gate voltage Vg of the IGBT 41 and illustrate operational state of the inverter referred to above. Namely, the inverter control circuit 48 detects a point P of intersection between Vce and its power source voltage Vcc and outputs the gate voltage Vg after a predetermined period Td (referred to as "synchronous oscillation control"). Then, the inverter control circuit 48 controls the pulse width Ton of the gate voltage such that a desired electromagnetic wave output of the magnetron 28 is obtained. Meanwhile, reference numeral 49 denotes a power source circuit. A terminal voltage of a resistor 50 is fed, as an anode current detecting signal of the magnetron 28, back to the inverter control circuit 48. The period Ton is controlled by this feedback signal such that the electromagnetic wave output of the magnetron 28 is controlled to an arbitrary set value.

Magnitude of the generated electric power output of the dynamo 22 is detected, as a DC output voltage of the rectification circuit 23, by resistors 51 and 52 so as to be supplied to the inverter control circuit 48. In response to this detection signal, the inverter control circuit 48 is capable of controlling operational state of the inverter 24. Thus, even if operational state of the power generator 20 varies greatly, deterioration of reliability due to generation of overload state in the dynamo 22 does not occur and proper electromagnetic wave heating can be performed by the magnetron 28.

Figure 4:
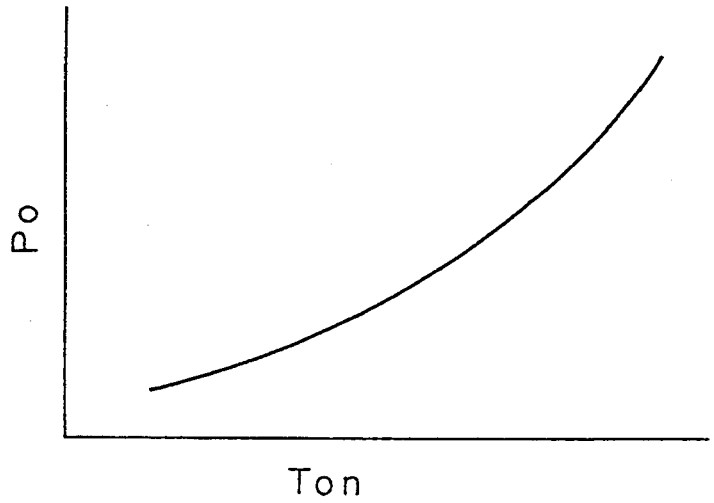
FIG. 4 is an operational characteristic diagram of the inverter of the high-frequency heating apparatus.

Namely, when the number of rotations of the power generator 22 has dropped extraordinarily, output of the dynamo drops. Hence, the period Ton of the IGBT 41 is reduced such that output voltage of the dynamo falls within a range enabling stable operation of the inverter power source 24, whereby consumed electric power of the inverter power source is so controlled as to conform to magnitude of output of the dynamo. Relation between Ton and Po is shown in FIG. 4 and Po changes in proportion to square of Ton. This is because electric power supplied to the magnetron 28 is substantially proportional to square of Icd by operation of the inverter shown in FIG. 3. On the contrary, in the case where output of the dynamo is too large, Po becomes too large when Ton is as it is, with the result that the IGBT 41, etc. may be thermally fractured due to not only excessive increase of heating output but excessive increase of loss of the inverter power source 24. Accordingly, also in this case, Ton is controlled to a small value such that high reliability and proper heating output are achieved.

Figure 5:
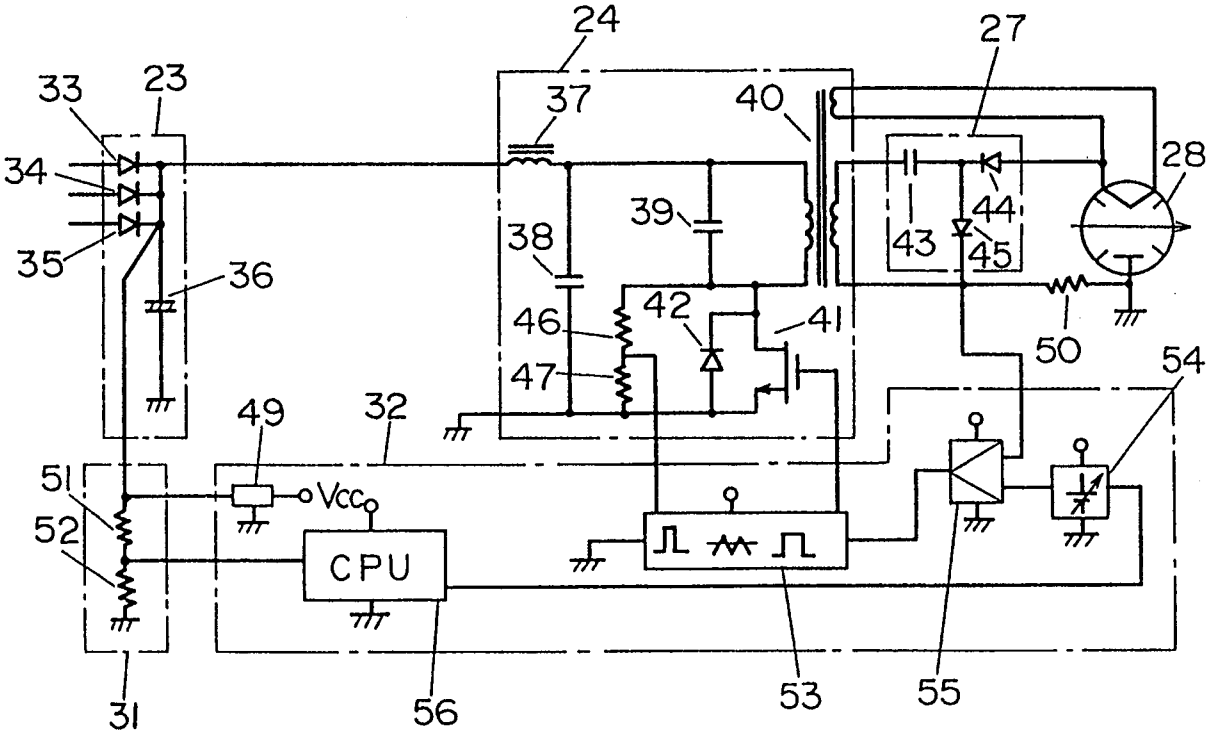
FIG. 5 is a circuit diagram showing a second embodiment of an inverter controller of the high-frequency heating apparatus.

FIG. 5 shows a second embodiment of the present invention and numerals identical with those of FIG. 2 denote the corresponding constituent elements. In FIG. 5, the inverter controller 32 is constituted by a PWM control circuit 53 for controlling Ton, which has a function of synchronous oscillation control as described in FIG. 3, a differential amplifier 55 for applying to the PWM control circuit 53, a difference signal between an anode current detection signal of the magnetron 28 and a signal of a reference signal generator 54 and a heating control circuit 56 for controlling, on the basis of a signal of the generated electric power output detecting means 31 for detecting magnitude of outputted electric power of the dynamo 22, a reference signal of the reference signal generator 54 to its corresponding value. This heating control circuit 56 can be easily formed by using, for example, a microcomputer and is adapted to perform overall adjustments of magnitude of electromagnetic wave output of the magnetron in accordance with a predetermined program as described below.

Figure 6:
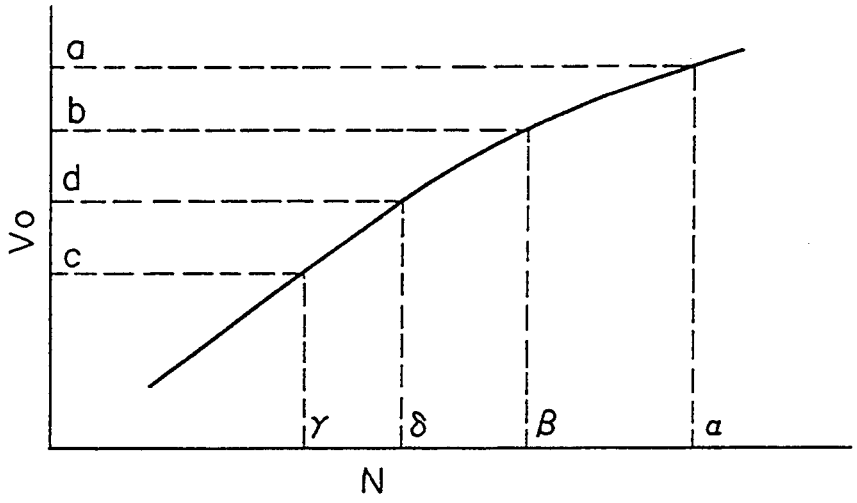
FIG. 6 is a characteristic diagram of the number of rotations of a dynamo and output voltage in the high-frequency heating apparatus.

When the number N of rotations of the dynamo 22 changes in accordance with change of operational state of the power generator 20, detection voltage Vo of the generated electric power output detecting means 31 changes as shown in FIG. 6 and fixed interrelation exists between N and Vo. Therefore, by detecting Vo in place of N, the arrangement of FIG. 5 in which the signal detecting circuit is greatly simplified can be employed.

Figure 7:
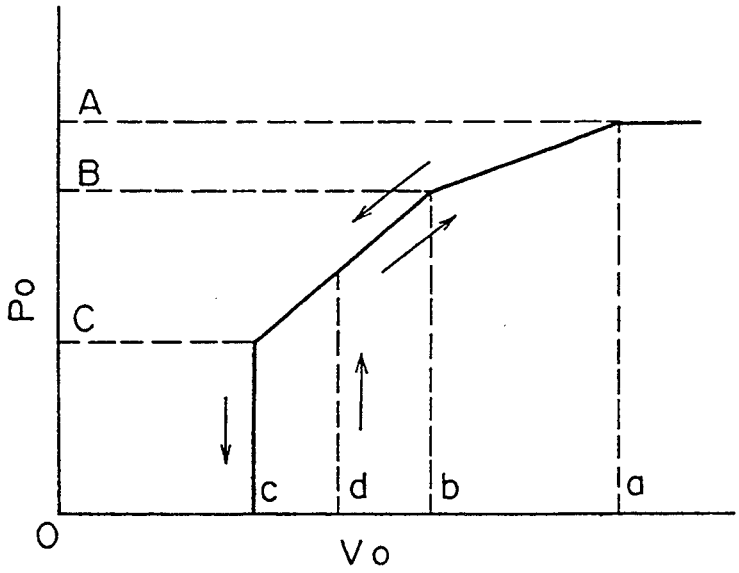
FIG. 7 is a characteristic diagram of the output voltage of the dynamo and high-frequency output in the high-frequency heating apparatus, FIGS. 8(*a*) and 8(*b*) are characteristic diagrams of high-frequency heating output and heating period in the high-frequency heating apparatus.

FIG. 7 shows one example showing how the heating control circuit 56 controls the output Po of the magnetron 28 with respect to Vo detected as the output signal of the dynamo. As Vo drops through a, b and c, Po is controlled low to A, B and C. Then, in an area in which Vo is smaller than c, Po is controlled to zero substantially or a state in which the inverter is operated at such a low input electric power that Po assumes zero substantially. Thus, the inverter power source 24 is operated at the excessively small Vo such that occurrence of inconveniences such as fracture of the IGBT 41 and failure of the dynamo 22 prevented. Then, even if Vo rises again, Po is prohibited from being outputted again until Vo rises to d. This is designed to prevent reduction of service life of the magnetron 28 or deterioration of reliability of the inverter power source 24 due to repetition of intermittent turning of the output Po of the magnetron 28 in an operational state of the power generator 20 in which Vo assumes a value close to c. Thus, the heating control circuit 56 is arranged control the reference voltage generator 54 such that Po as shown in FIG. 7 in response to change of Vo.

Figure 8A:
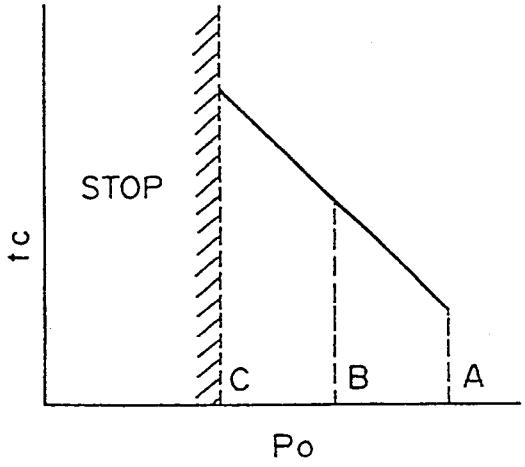
Figure 8B:
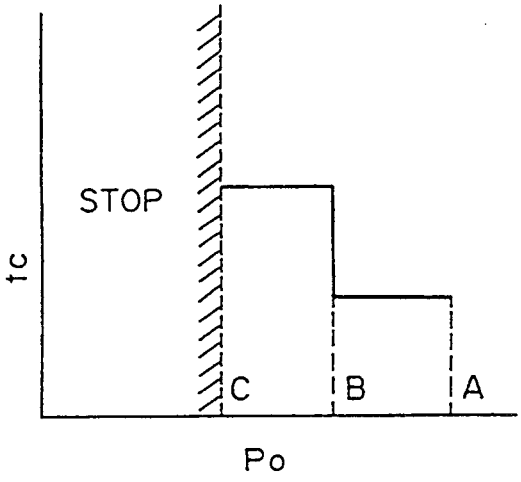

The heating control circuit 56 is arranged adjust a heating period tc of the food 30, etc. in response to change of the output Po of the magnetron 28 as in FIG. 8(*a*) or 8(*b*). FIG. 8(*a*) shows a case in which the heating period tc is increased proportionally as Po changes through A, B and C and operation of the inverter power source 24 is stopped substantially when Po is not more than C. On the other hand, FIG. 8(*b*) shows an embodiment in which an area of change of Po is divided into two regions between A and B and between B and C such that different fixed heating periods tc are allocated to the regions, respectively. Practically, by correcting the heating periods tc in such an arrangement, sufficient heating correction control response to change of Po can be performed.

Figure 9:
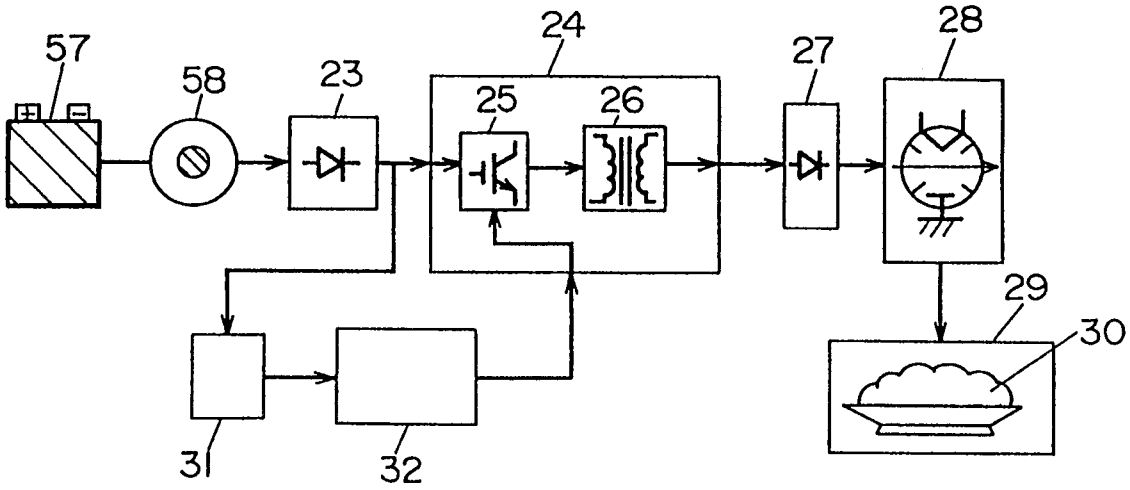
FIG. 9 is an overall block diagram of a third embodiment of the present invention.

Meanwhile, FIG. 9 shows a third embodiment including a battery 57, a transmission cable 58, the rectification means 23, the inverter power source 24, the rectifier 27, the magnetron 28 and the oven 29. Numerals identical with those referred to above are operated in a similar manner and detailed description thereof is abbreviated.

By the above described arrangement, the transmission cable 58 transmits to the inverter power source 24 through the rectification means 23, whole electric power received from the battery 57. This DC power is converted to a high-voltage power by the inverter power source 24 and is rectified by the rectifier 27 so as to be applied to the magnetron 28. By the above mentioned high-voltage power, the magnetron 28 irradiates microwave into the oven 29 so as to heat the article 30 to be heated.

By employing the above mentioned arrangement, electric power is stably obtained from the battery 57. Meanwhile, since the transmission cable 58 does not supply electric power except for the inverter power source 24, voltage drop due to the transmission cable can be minimized.

Figure 10:
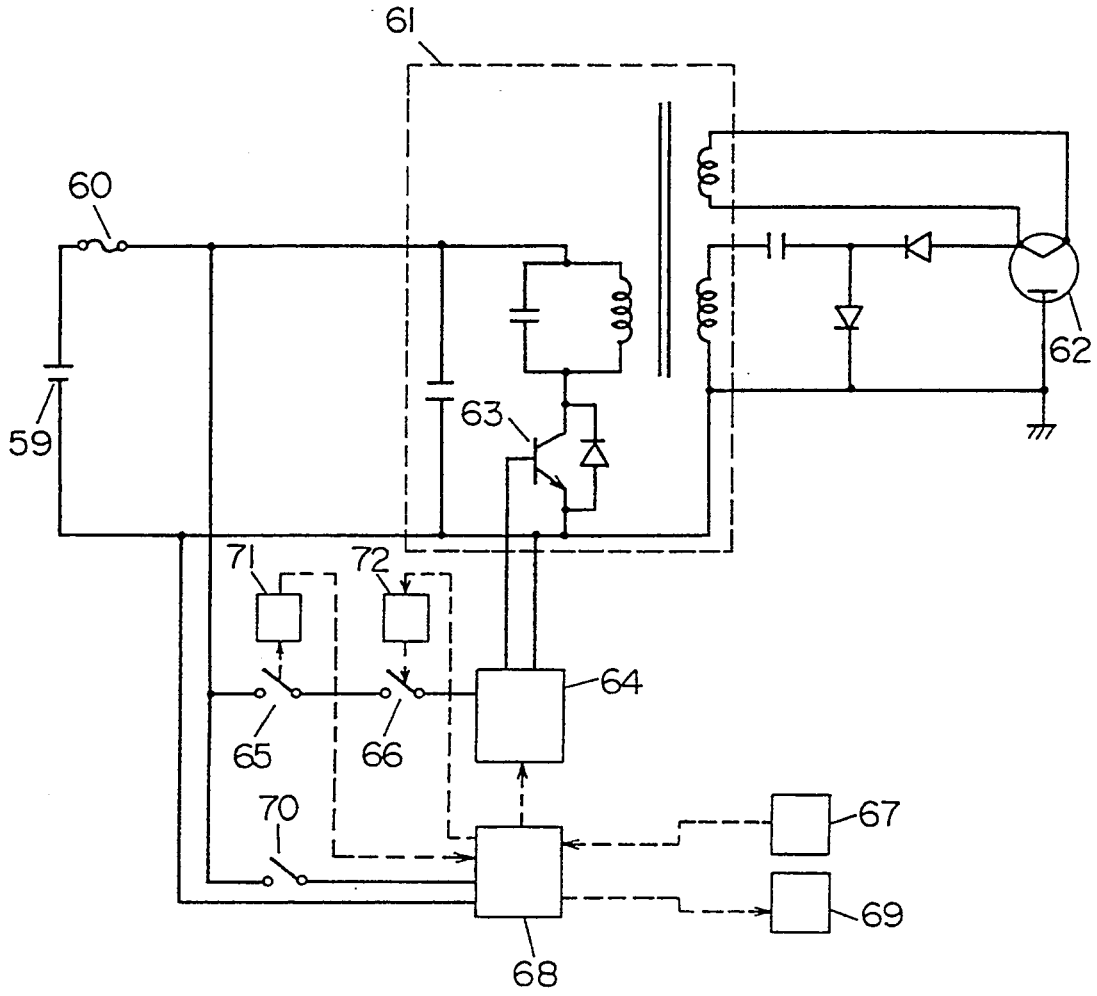
FIG. 10 is an overall block diagram of a fourth embodiment of the present invention.

FIG. 10 is a circuit diagram showing an arrangement of a high-frequency heating apparatus according to a fourth embodiment of the present invention, in which a low-voltage DC power source 59 such as a cell is connected to an inverter power source 61 via a breaker means 60 for breaking in the case of flow of overcurrent, for example, a fuse. The inverter power source 61 converts DC low voltage obtained from the DC power source 59 into DC high voltage and AC high voltage so as to actuate a magnetron 62. The magnetron 62 generates microwave and this microwave is introduced into a heating chamber of the high-frequency heating apparatus so as to heat an article to be heated such as a food, accommodated in the heating chamber.

The inverter power source 61 employs a semiconductor switching element 63 such as a transistor and this semiconductor switching element 63 is driven by an oscillator 64. The oscillator 64 is connected to the DC power source 59 by way of a door switch 65 turned on and off by opening and closing of a door for accommodating in the high-frequency heating apparatus the article to be heated, a switch 66 for the oscillator and a breaker means 60 so as to receive supply of electric power.

An input means 67 is a means for inputting information on operation, stop, operating period, etc. of the high-frequency heating apparatus. The information from the input means 67 is transmitted to a control circuit 68. In response to the information from the input means 67, the control circuit 68 controls operation, stop, intermittent operation, continuous operation, etc. of the oscillator 64 and transmits to a display means 69, information on operational state. The display means 69 displays the operational state in response to the information from the control circuit 68. The control circuit 68 is connected to the DC power source 59 through a switch 70 for the control circuit 68 and the breaker means 60 so as to receive supply of electric power.

When the switch 70 is turned on, electric power is supplied to the control circuit 68 so as to start operation of the control circuit 68. The control circuit 68 controls the oscillator 64 on the basis of the information from the input means 67. In the case where the door of the high-frequency heating apparatus is open, the control means 68, response to information from a detection means 71 for detecting ON/OFF state of the door switch 65, namely opening or closing state of the door of the high-frequency heating apparatus, not only controls to stop operation of the oscillator 64 but turns off, through a switch operating means 72, the switch 66 for supplying electric power to the oscillator 64 so as to intercepts supply of electric power.

Even if a signal for turning on the switch 66 for the oscillator is supplied from the control circuit 68 to the switch operating means 72 for some reason or other in spite of the fact that the door is open, the door switch 65 and the switch 66 for the oscillator are connected in series and the door switch 65 is turned off, so that electric power is not supplied to the oscillator 64 and thus, the oscillator 64 is not operated. Thus, the inverter circuit is not operated, so that microwave is not generated safely.

Since electric power required for the control circuit 68 and the oscillator 64 is as small as 1 W and 3 W approximately, respectively, the switch 70 for the control circuit, which is a switch for transmitting electric power to the control circuit 68 and the oscillator 64, the door switch 65 and the switch 66 for the oscillator may be quite compact.

The inverter power source 61 is subjected to switching by a signal applied to the semiconductor switching element 63 from the oscillator 64 and generates DC high voltage and AC voltage so as to actuate the magnetron 62. Therefore, operation of the inverter power source 61 is performed by opening and closing of the switch 70 for supplying electric power to the control circuit 68. When overcurrent flows due to repetitive supply of signals to the semiconductor switching element 63 for some cause or other, supply of electric power to the inverter power source 61 is intercepted by the breaker means 60 and thus, fires due to overheat can be prevented.

Figure 11:
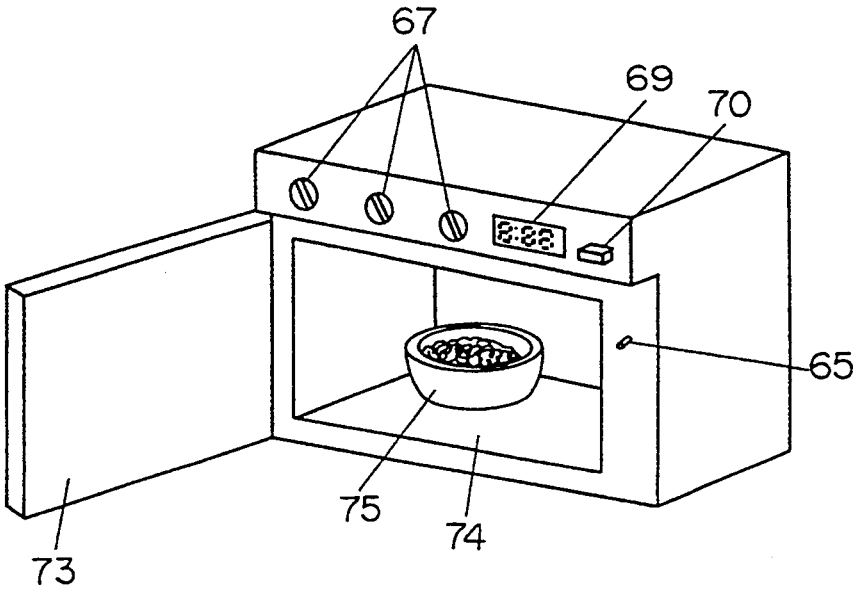
FIG. 11 is a perspective view of the external appearance of the high-frequency heating apparatus.

FIG. 11 is a perspective view of external appearance showing an arrangement of a high-frequency heating apparatus according to a fourth embodiment of the present invention. In FIG. 11, the switch 70 for the control circuit, the input means 67 and the display means 69 are provided on a front face of the high-frequency heating apparatus so as to be operated easily and viewed easily.

By turning on and off the switch 70 for the control circuit, the high-frequency heating apparatus can be operated and stopped. The door switch 65 is mounted so as to be turned on and off in response to opening and closing of a door 73 for accommodating in a heating chamber 74 an article 75 to be heated.

Figure 12:
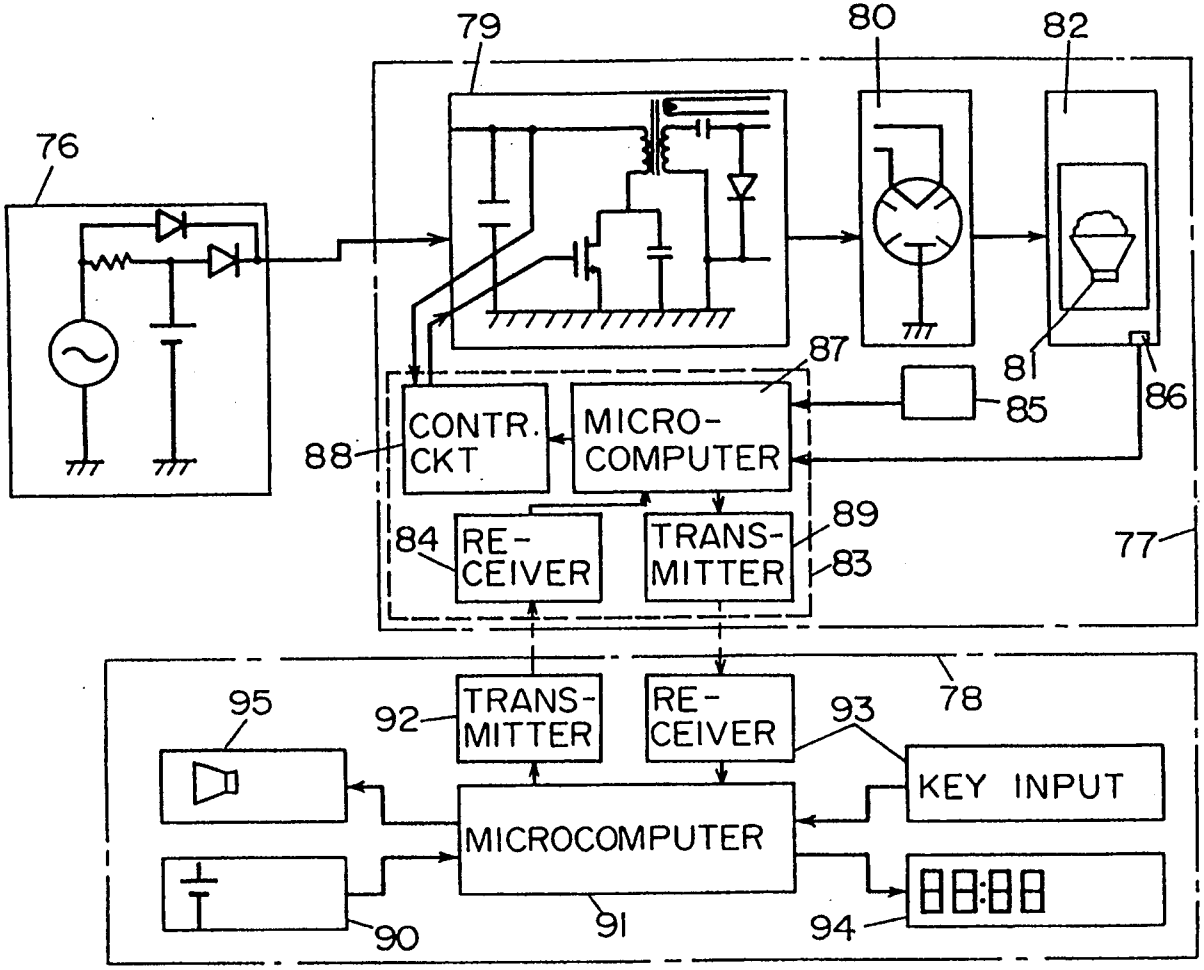
FIG. 12 is an overall block diagram of a fifth embodiment of the present invention.

Meanwhile, FIG. 12 shows a fifth embodiment of the present invention, which is constituted by a power source 76, an apparatus body 77 and an operating portion 78. The power source 76 is formed by a battery, a dynamo, etc. The apparatus body 77 is constituted by an inverter power source 79 for converting output of the power source 76 into high-frequency power, a magnetron 80 driven by the output of the inverter power source 79, a heating chamber 82 for heating by output of the magnetron 80 an article 81 to be heated and an output controller 83 for controlling operational state of the inverter power source 79 so as to adjust output electromagnetic wave of the magnetron 80.

Furthermore, the output controller 83 is constituted by a infrared ray receiver 84 in which an operational command of infrared rays is received from the operating portion 78 so as to be converted into a cooking command signal, a microcomputer 87 which receives the operational command signal from the infrared ray receiver 84 and information from a door switch 85 for detecting opening and closing of the door and from a temperature sensor 86 for detecting temperature of the heating chamber 82, a control circuit 88 for controlling operational state of the inverter power source 79 on the basis of a cooking command from the microcomputer 87 and an infrared ray transmitter 89 in which the cooking information from the microcomputer 87 is converted into infrared rays so as to be transmitted to the operating portion 78.

Meanwhile, the operating portion 78 is constituted by a cell 90, a microcomputer 91 which receives electric power from the cell 90 so as to be operated, a key input portion 93 which is connected to the microcomputer 91 so to perform key input, a liquid crystal display 94 which is also connected to the microcomputer 91 so as to display at least key input, cooking information, etc., a buzzer 95 which is also connected to the microcomputer 91 so as to inform at least key input, transmission of the cooking information or completion of cooking, an infrared ray transmitter 92 which is also connected to the microcomputer 91 which is also connected to the microcomputer 91 so as to transmit at least an operational command such as the cooking information to the body 77 and an infrared ray receiver 93 which is also connected to the microcomputer 91 so as receive the cooking information transmitted from the body 77, etc.

In the above described arrangement, when the cooking information is inputted to the microcomputer 91 from the key input portion 93, the cooking information is converted into an operational command by the microcomputer 91 such that not only the operational command is transmitted to the infrared ray transmitter 92 but contents of the operational command are displayed by the liquid crystal display 94. The infrared ray transmitter 92 which received the operational command transmits the operational command to the infrared ray receiver 84 of the apparatus body 77 by infrared rays. Meanwhile, in the apparatus body 77, the inverter power source 79 is driven through the control circuit 88 by the microcomputer 87 which has received the operational command signal from the infrared ray receiver 84. Then, the article 81 to be heated in the heating chamber 82 is cooked through heating by high-frequency output of the magnetron 80 which received electric power of the inverter power source 79. Meanwhile, in the microcomputer 87, not only the control circuit 88 is controlled on the basis of information from the door switch 85 and the temperature sensor 86 such that optimum cooking is performed but information on completion of reception of the operational command, completion of cooking, remaining cooking period, etc. is transmitted the infrared ray transmitter 89. Such information transmitted from the infrared ray transmitter 89 is processed by the microcomputer 91 via the .infrared ray receiver 93 so as be subsequently informed of an operator by the buzzer 95 or the liquid crystal display 94.

Figure 13:
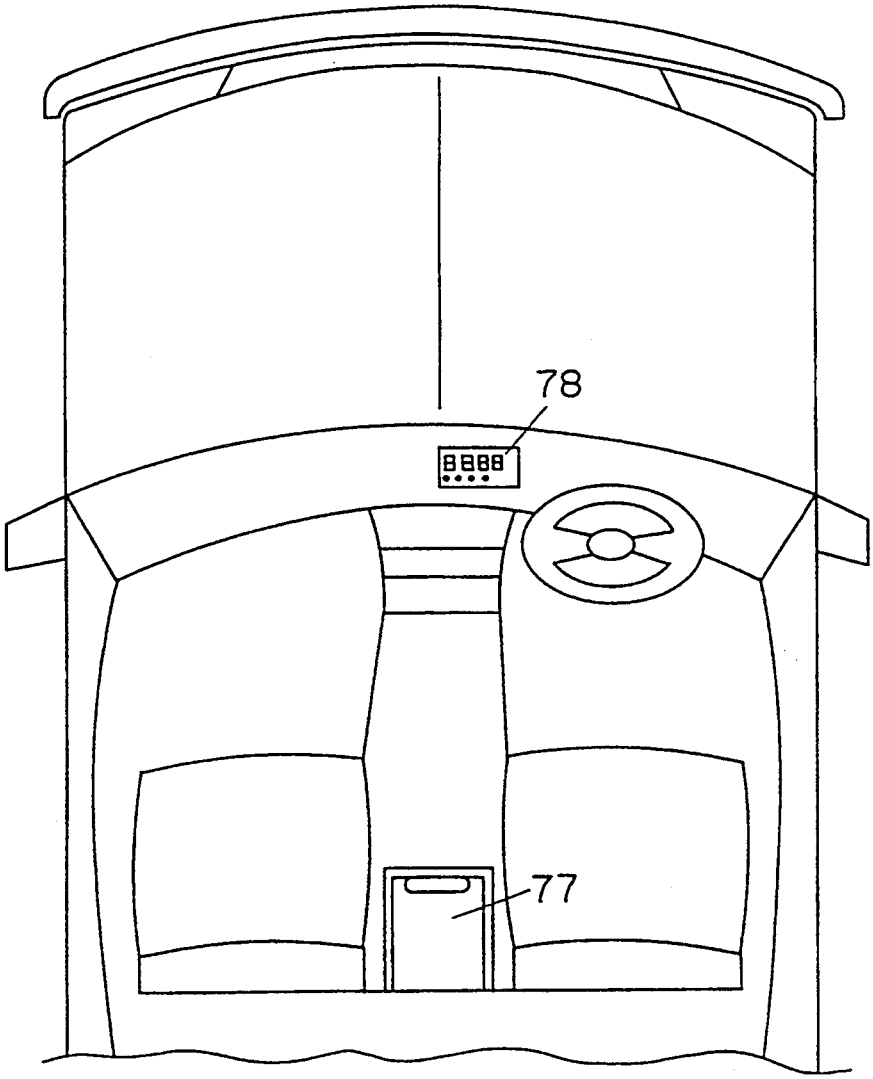
FIG. 13 is a view showing the high-frequency heating apparatus mounted on a motor vehicle.

Thus, in accordance with the high-frequency heating apparatus for the vehicle, according to the present invention, since the operating portion 78 is detachably mounted on the apparatus body 77, the operating portion 78 can be provided at a location easiest to operate as shown in FIG. 13. Hence, operational performance is improved. Furthermore, since position of installation of the apparatus body 77 is not restrained by position of the operating portion 78, the apparatus body 77 is not necessarily required to be placed at a position which not only can be viewed from a driver but falls within a reach of hands of the driver. Therefore, such an effect is obtained that the apparatus body 77 can be mounted in even a small vehicle.

Meanwhile, at least one of the infrared ray receiver and the infrared ray transmitter is provided at each of the operating portion 78 and the apparatus body 77 such that the operational command is transmitted and received in air. Hence, since connection between the operating portion 78 and the apparatus body 77 becomes unnecessary, restrictions or troubles in position of installation of the operating portion 78 at the time of installation of the operating portion 78 are eliminated and, at the same time, aggravation of external appearance due by connection is not incurred. Furthermore, such an effect is brought about that infrared rays do not exert influence of noises upon electronic devices in the vehicle.

Meanwhile, since the display 94 and the operating portion 78 is integrally provided, key input can be confined or progress of cooking can be judged by viewing the operating portion 78 placed at a location distant from the apparatus body 77, so that an effect is brought about that operational easiness is improved.

Figure 14A:
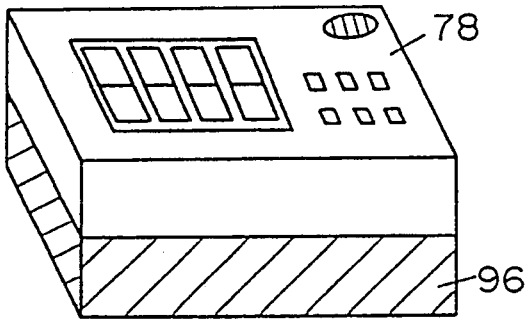
FIG. 14 is an enlarged perspective view and sectional views of an operating portion of the high-frequency heating apparatus.
Figure 14B:
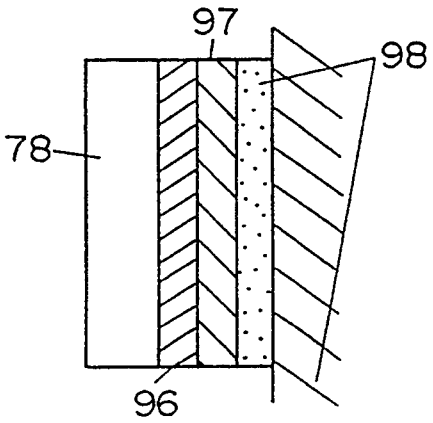
Figure 14C:
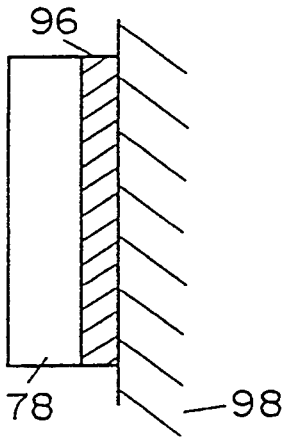

FIG. 14 shows another example of the operating portion of the present invention, which is different from that of the above mentioned embodiment in that a mounting means formed by a magnet 96 is provided on a rear face of the operating portion 78 as shown in FIG. 14(*a*). In the case where the magnet 96 does not adhere to a location for mounting the operating portion 78, for example, a vehicle body, a metal 97 to which the magnet 96 adhere is bonded to a body 98 of the vehicle by using a double-coated tape as shown in FIG. 14(*b*). In the case where the body 98 of the vehicle is made of metal to which the magnet 96 adhere, the operating portion 78 is directly provided on the body 98 of the vehicle through adhesion of the magnet 96 thereto.

By this arrangement, such effects are achieved that the operating portion 78 can be provided at an arbitrary position of the vehicle through adhesion of the operating portion 78 thereto without performing working for forming a hole at a portion of the vehicle and that the operating portion 78 can be operated by placing the operating portion 78 at a location optimum for a situation of its use. Meanwhile, the mounting means may be replaced by a method other than the magnet, such as a fastener.

Figure 15:
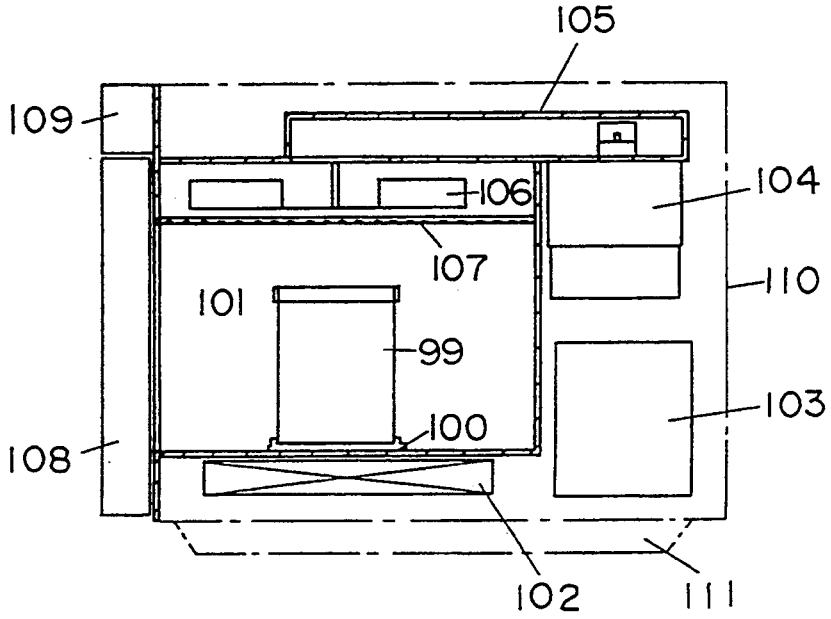
FIG. 15 is a sectional view of a sixth embodiment of the present invention.
Figure 16:
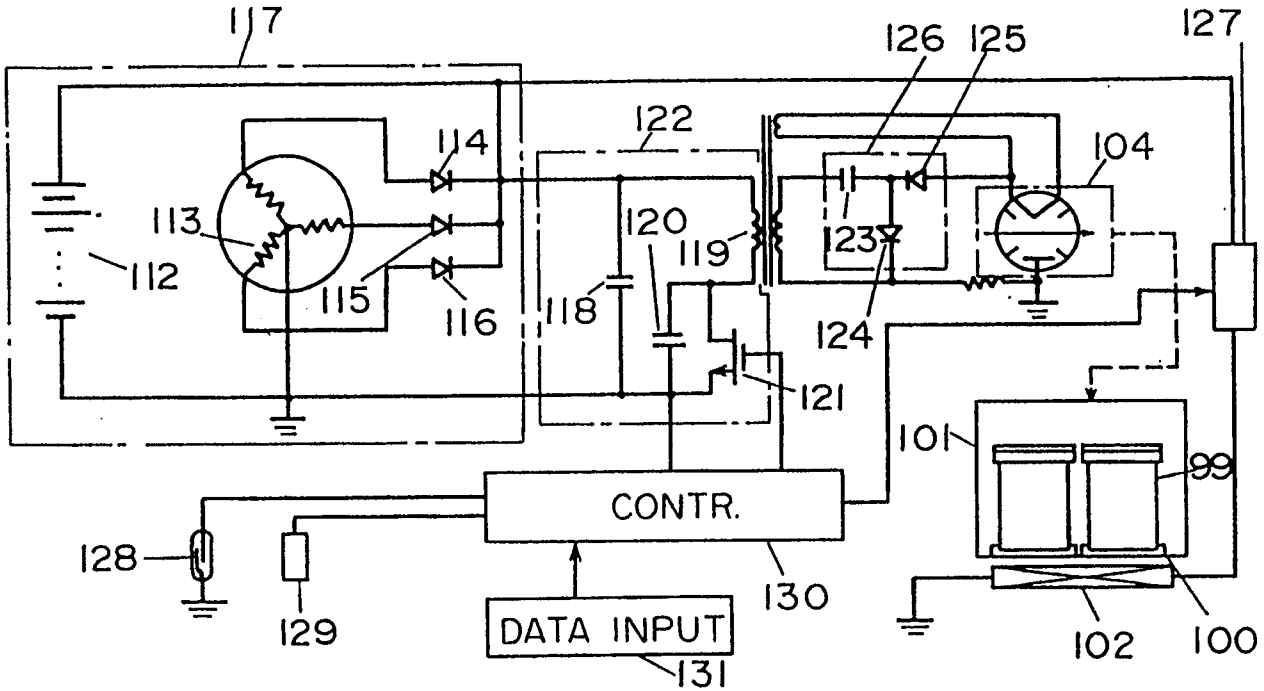
FIG. 16 is a whole circuit diagram of the high-frequency heating apparatus.

FIGS. 15 and 16 show a sixth embodiment of the present invention. In FIGS. 15 and 16, numeral 99 denotes a container in which the article to be heated is accommodated, numeral 100 denotes a structural member fixed to the container and made of magnetic material, numeral 101 denotes a heating chamber in which the article to be heated is accommodated, numeral 102 denotes an electromagnet provided adjacent to a bottom face of the heating chamber and numeral 103 denotes a power source for controlling drive of a magnetron 104 for generating microwave supplied to the heating chamber and the electromagnet 102. Meanwhile, numeral 105 denotes a waveguide, numeral 106 denotes a means for stirring electromagnetic wave, numeral 107 denotes a partition plate made of material having low loss of microwave, numeral 108 denotes a door for putting into and out of the heating chamber the article to be heated, numeral 109 denotes an operating panel, numeral 110 denotes a body and numeral 111 denotes a body support.

Numeral 112 denotes a battery and numeral 113 denotes an alternator for generating AC power by an internal combustion engine. Output of the alternator 113 is rectified by diodes 114 to 116 and the alternator 113 is connected in parallel to the battery 112 so as to form a DC power source 117 for driving the high-frequency heating apparatus. DC voltage of this DC power source is supplied to an inverter power source 122 which is constituted by a smoothing condenser 118, a boosting transformer 119, a resonance capacitor 120, a transistor 121, etc. Output of the inverter power source 122 is supplied, as outputs of two secondary windings of the boosting transformer 119, to the magnetron 104. The output of the high-voltage secondary winding is converted into DC high voltage by a high-voltage rectification circuit 126 constituted by a capacitor 123 and diodes 124 and 125 and then, is supplied to the magnetron. On the other hand, the output of the low-voltage secondary winding is supplied to a cathode of the magnetron. Meanwhile, DC voltage of the DC power source 117 is inputted to an electromagnet drive circuit 127 for generating voltage supplied to the electromagnet 102.

Numeral 128 denotes an acceleration detecting means which is of a type employing a magnetic weight and a differential coil, a type employing a weight magnet and a magnetic conversion element or the like. The acceleration detecting means is provided in a mobile means such as a motor vehicle, a ship, etc., on which this apparatus is mounted. Numeral 129 denotes a centrifugal force detecting means or an angular velocity detecting means which is of a type detecting steering angular velocity mainly from a rotary slit and a photocoupler in its provision in the mobile means and is formed by either a weight and a differential coil or a magnetic conversion element. A control portion 130 is mainly constituted by an inverter power source controller for controlling energization period of the transistor 12 synchronously with resonance state of a resonance circuit including the boosting transformer 119 and the resonance capacitor 120 on the basis of a data input signal 131 of heating information of the article to be heated energization period of the transistor 121, which is inputted from the operating panel of the high-frequency heating apparatus and a controller which actuates the electromagnet drive circuit 127 on the basis of output from the acceleration detecting means 128 and the centrifugal force detecting means or the angular velocity detecting means 129 so as to actuate the electromagnet 102.

By the above described arrangement, the container in which the article to be heated is accommodated or on which the article to be heated is placed is integrally combined with the structural member made of magnetic material and is placed on the bottom face of the heating chamber. In response to states of start of running, acceleration, sudden stop, curved running, clash from behind, etc. (hereinbelow, referred to as "unstable states"), the acceleration detecting means and the centrifugal force detecting means or the angular velocity detecting means input their own output signals to tile control portion 130. The control portion 130 calculates amount of change of these signals with time. As soon as change of either one of the input signals has exceeded a preliminarily stored reference change amount, the control portion 130 transmits to the electromagnet drive circuit 127 a command for actuating the electromagnet 102 such that the structural member fixed to the container is attracted to the bottom face of the heating chamber. Furthermore, the control portion 130 stops a drive signal outputted to the transistor 121 so as to terminate heating action. As a result, it is possible to prevent turnover of the container in which the article to be heated is accommodated. Meanwhile, it is possible to prevent in advance an abnormal operation at the time of splash of water, etc. over the electric circuit.

Meanwhile, in the apparatus of this kind, operation of the drive power source of the magnetron is controlled on the basis of closing state of the door. However, operation of the electromagnet may also be controlled independently of a closing signal of the door.

In the case of an arrangement in which the electromagnet is operated only during a predetermined period on the basis of a signal indicative of the unstable states, operational period of the electromagnet is updated when a signal indicative of the unstable states has been further sent from each detection means while the electromagnet is being operated. This updating time may be determined by a time point at which a final signal indicative of the unstable states has been sent.

Furthermore, the magnetic material fixed to the container may also be magnetized preliminarily. In this case, the magnetic material can be more securely attracted and held in an abnormal state.

Figure 17:
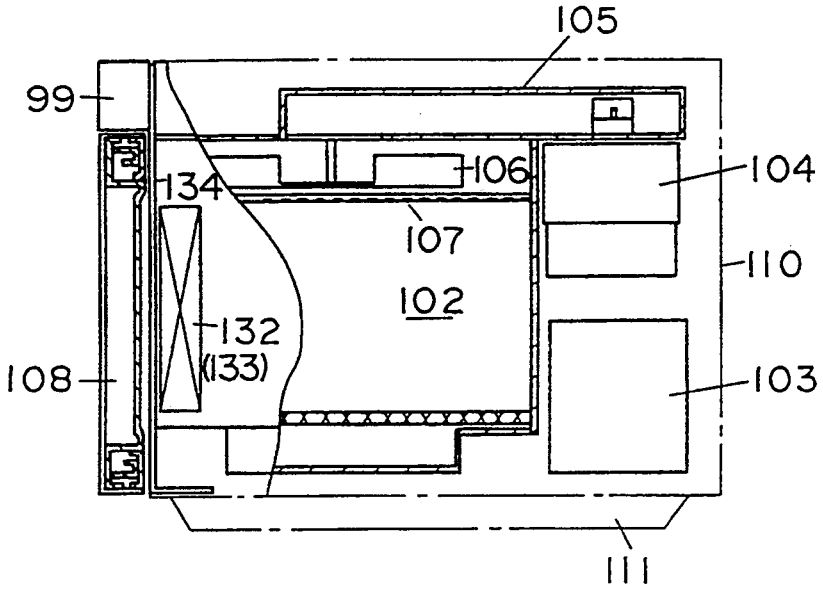
FIG. 17 is a sectional view of a body of a seventh embodiment of the present invention.
Figure 18:
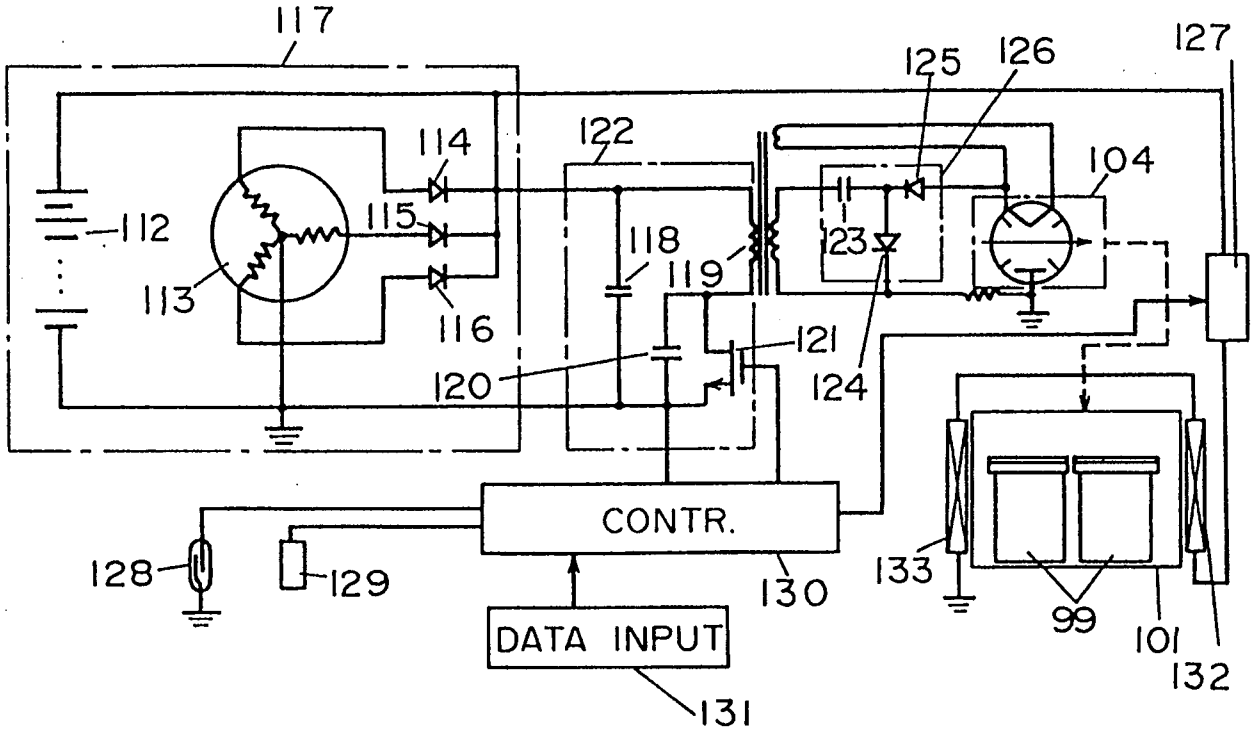
FIG. 18 is an overall circuit diagram of the high-frequency heating apparatus.

FIGS. 17 and 18 show a seventh embodiment of the present invention. An arrangement different from that of the sixth embodiment is that electromagnets 132 and 133 are provided adjacent to a body wall surface 134 confronting the door 108. Thus, when the electromagnets have been actuated, the door is magnetically attracted and held towards the body such that the article to be heated is prevented from being scattered from the heating chamber out of this apparatus in the unstable states. The constituent elements corresponding to those of FIGS. 15 and 16 are designated by identical numerals.

Meanwhile, the arrangement in which the door is magnetically attracted and held and the arrangement in which the container accommodating the article to be heated is magnetically attracted and held may be employed in combination. In this case, conveniences of this apparatus are doubly promoted in the mobile means.

Furthermore, since a gravity detecting means and a control portion catch change of gravity applied to this apparatus at any moment, it is possible to forecast future gravity change on the basis of the change amount. For users of this apparatus, a state in which the door cannot be opened or the article to be heated cannot be taken out even if the unstable states are not noticed is a means for informing the users of the unstable states sensitively. For example, such a phenomenon can be beforehand avoided that immediately after coffee made hot has been taken out, the unstable states are created and thus, the coffee is spilt.

Figure 19:
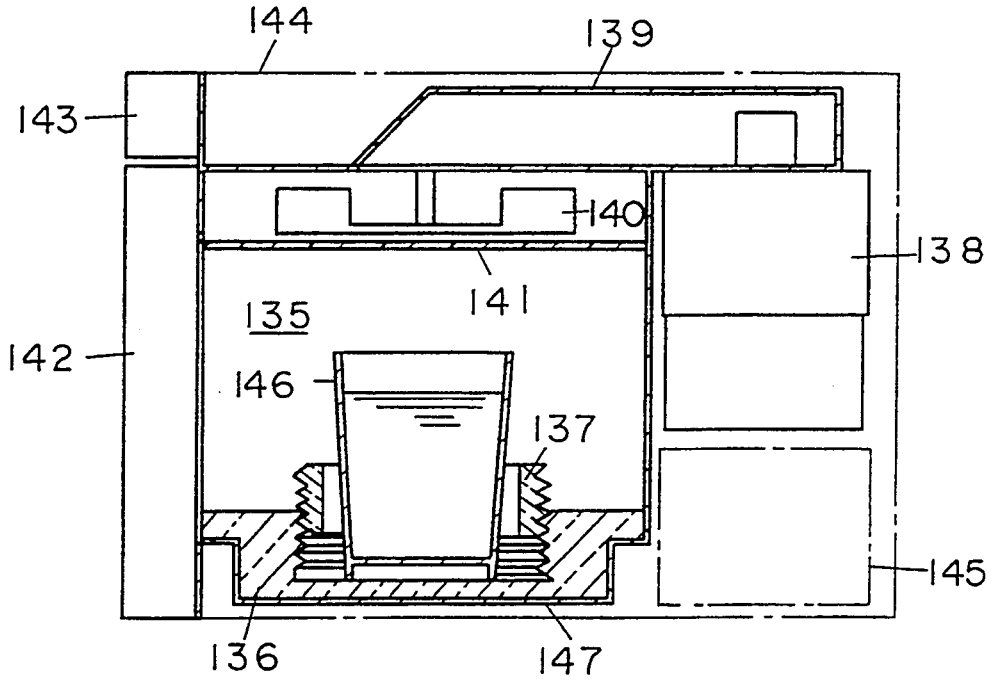
FIG. 19 is a sectional view of a body of an eighth embodiment of the present invention.

Moreover, FIG. 19 shows an eighth embodiment of the present invention. In FIG. 19, numeral 135 denotes a heating chamber for accommodating an article to be heated, numeral 136 denotes a first member which is provided on the bottom face of the heating chamber and is worked concavely at its substantially central portion and numeral 137 denotes a cylindrical second member which is assembled with an outer periphery of the concave portion of the first member. These first and second members are assembled through threaded engagement. Numeral 138 denotes a magnetron for generating microwave supplied to the heating chamber, numeral 139 denotes a waveguide, numeral 140 denotes a stirrer for stirring microwave supplied to the heating chamber, numeral 141 denotes a partition plate, numeral 142 denotes a door, numeral 143 denotes an operating panel, numeral 144 denotes a body, numeral 145 denotes an electronic range driving power source actuated by a power source of a motor vehicle and numeral 146 denotes a container in which a fluid food is accommodated.

By the above described arrangement, the container accommodating the fluid food is placed on the concave portion of the first member. By rotating the second member in this state, depth of the concave portion can be varied a proper value corresponding to the container. Since the container is stored and fixed in the concave space, spill of the fluid food can be prevented.

Meanwhile, the bottom face of the heating chamber is preliminarily subjected to proper spinning such that depth of the concave portion defined by the first and second members enables accommodation of not less than a half of the container. In order to rotate the second member conveniently, it is preferable that a finger hole for rotation be formed on an upper face of the second member. Furthermore, since each member is made of nonmetallic, the article to be heated is placed above the bottom face of the heating chamber made of metallic material. Thus, even if the article to be heated is small in thickness, upper and lower surfaces of the article to be heated can be heated effectively.

Figure 20:
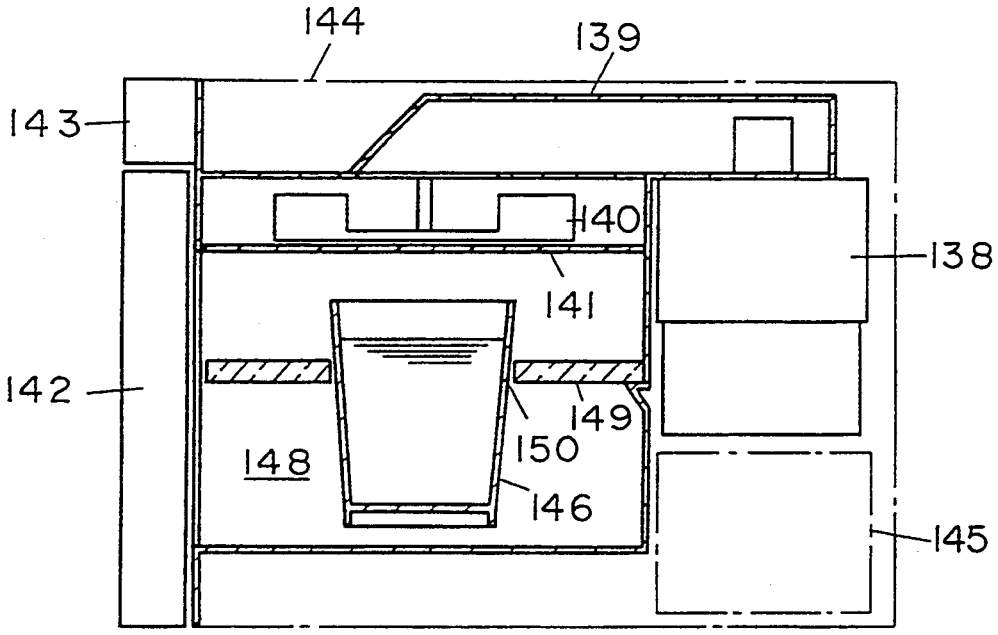
FIG. 20 is a sectional view of a body of a ninth embodiment of the present invention.

Then, description is given with reference to FIG. 20. In FIG. 20, members identical with those of FIG. 19 are designated by identical numerals. In FIG. 20, numeral 148 denotes a heating chamber for accommodating an article to be heated and numeral 149 denotes a member which is detachably mounted on a side wall of the heating chamber 148. The member 149 is made of nonmetallic material having low loss of microwave and is formed with a hole 150 of a predetermined shape into which a container stored on a bottom face of the heating chamber is inserted so as to be supported.

By the above described arrangement, a container 146 in which a fluid food is accommodated is inserted into the predetermined hole of the member 149 so as to be supported by the member 149. Movement of this member 149 is restrained by four sides of the heating chamber, which include the door 142. Therefore, the container 146 is supported and fixed in space of the heating chamber by the member 149. Thus, vibrations of the motor vehicle are transmitted to the container in a more damped state.

Meanwhile, when not in use, this member 149 is placed on the bottom face of the heating chamber so as to be stored. When this member 149 is stored on the bottom face of the heating chamber or is used by being taken out, the hole for inserting the container thereinto can be used to full extent. As described with reference to FIG. 19, when the member 149 is stored on the bottom face of the heating chamber, heating of the article to be heated can be promoted effectively from its upper and lower surfaces even if the article to be heated is small in thickness.

Figure 21:
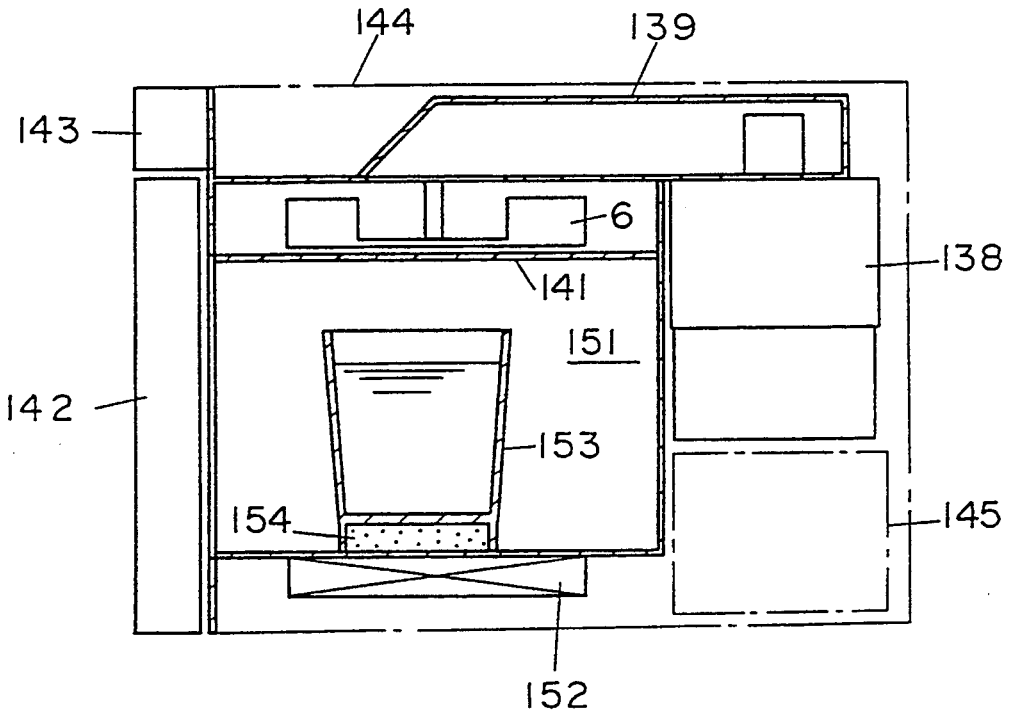
FIG. 21 is a sectional view of a body of a tenth embodiment of the present invention.
Figure 22:
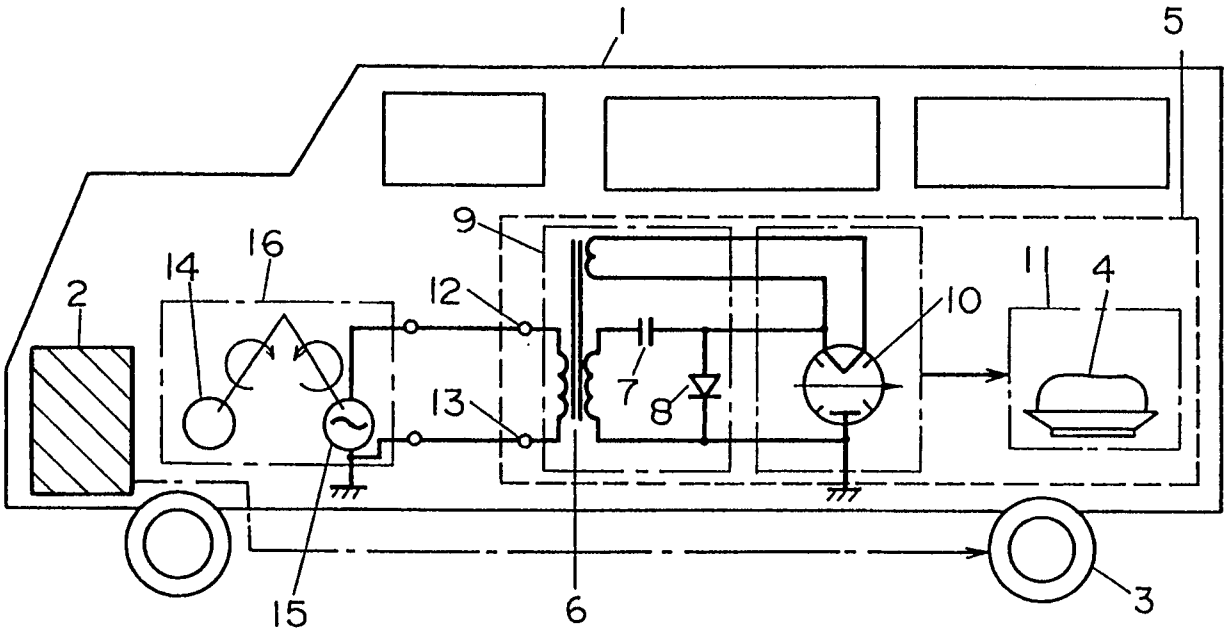
FIG. 22 PRIOR ART
FIG. 22 is a view showing an arrangement of a high-frequency heating apparatus mounted on a motor vehicle.

Also in FIG. 21, members identical with those of FIG. 19 are designated by identical numerals. In FIG. 21, numeral 151 denotes a heating chamber for accommodating an article to be heated, numeral 152 denotes an electromagnet which is provided adjacent to a bottom face of the heating chamber and numeral 153 denotes a container having a bottom face provided with magnetic material 154.

By the above mentioned arrangement, when the electromagnet is actuated after the container 153 containing a fluid food has been accommodated, the magnetic material provided on the bottom face of the container is attracted by magnetic field produced by the electromagnet such that the container 153 is attracted and fixed to the bottom face of the heating chamber.

Meanwhile, actuation of the electromagnet is controlled by employing control associated with opening and closing states of the door 142, manual control using an independent operating key, automatic control based on driving state of the motor vehicle, etc. individually or in combination.

INDUSTRIAL APPLICABILITY

As described above, in accordance with the present invention, it is so arranged that output of the dynamo actuated by the power generator is rectified into DC power and this DC power is supplied to the magnetron by the inverter power source. When operational state of the inverter power source is arranged to be controlled in accordance with magnitude of generated electric power output by the generated electric power output detecting means and the inverter controller, high-voltage power can be easily supplied to the magnetron even if the power generator, the dynamo and the battery, which are simple in structure, inexpensive and have poor accuracy in output stability, are used. Furthermore, even at a location where it is difficult to employ a commercial power source, required stable dielectric heating function can be achieved and thus, increasing demand for utilization of high-frequency heating apparatuses can be satisfied. Since especially, the arrangement in which DC power converted from output of the dynamo is supplied to the magnetron by the inverter power source can provide high controllability of supplied electric power, control of operational state, corresponding to output of the dynamo, namely, control of electric power can be performed easily. Since the dynamo and the power generator are stable, reliable operation and excellent dielectric heating function can be achieved simultaneously.

Meanwhile, when in the arrangement in which DC power is obtained by rectifying output of the dynamo actuated by the power generator for transporting human beings or baggages, operational state of the inverter power source is adapted to be controlled in accordance with output of the dynamo by the generated electric power output detecting means and the inverter controller, the dielectric heating apparatus for the transport apparatus can be easily achieved by using the dynamo acting also as the power generator, having low accuracy in output stability and having a simple structure and required dielectric heating function can be obtained stably.

Furthermore, if the inverter controller is arranged to substantially stops operation of the inverter operational state of low input electric power in which electromagnetic wave output assumes zero substantially is included) when output of the dynamo is not more than a predetermined value, generation of overload state of the power generator and the dynamo in terms of electric power and abnormal operation or fracture of the inverter can be prevented positively and a high-frequency heating apparatus having high reliability can be provided.

In addition, by using a battery as the DC power source, an electric power generator such as the dynamo is made unnecessary and high-frequency heating can be performed freely even at a location having no mobile means.

Meanwhile, when it is so arranged that the transmission line for transmitting electric power from the battery to the inverter power source is not branched to others, voltage drop due to the transmission line is minimized and electric power can be stably transmitted to the inverter power source. Furthermore, erroneous operation of other devices due to switching noises of the inverter power source can be prevented.

Meanwhile, by employing the arrangement in which the apparatus body and the operating portion are provided detachably, the body can be mounted in even a compact vehicle. Moreover, the high-frequency heating apparatus for vehicles can be achieved which can be operated at a location which is easiest to operate during running and the body can be installed at a location suitable for its installation. Thus, the high-frequency heating apparatus can be mounted in a vehicle which is not so large as a leisure vehicle.

In the arrangement in which changes of gravity applied to this apparatus are detected by the acceleration detecting means, the centrifugal force detecting means or the angular velocity detecting means, the unstable states in environments of use of this apparatus, such as accelerated or decelerated running state of the mobile means or curved running state at a fixed velocity can be detected and safe environments of use of the apparatus can be achieved.

What is claimed is:

1. A high-frequency heating apparatus which is mounted on a transport device for transporting at least one of human beings, animals and articles, comprising:

a DC power source;

an inverter power source which receives DC power obtained from said DC power source;

a magnetron which is actuated by an output of said inverter power source;

an error amplifier which applies to a pulse width control circuit a signal indicative of difference between..an output signal of a current detecting means for detecting current flowing through said magnetron and an output signal of a reference signal generator; and a DC output detecting means for directly or indirectly detecting a magnitude of an output of said DC power source;

wherein an operation of said inverter power source is controlled by an output of said pulse width control circuit and an output of said reference signal generator is controlled on the basis of a signal of said DC output detecting means.

2. A high-frequency heating apparatus as claimed in claim 1, wherein said DC power source is constituted by a dynamo and a rectification means for rectifying output of said dynamo.

3. A high-frequency heating apparatus as claimed in claim 1, wherein said DC power source is constituted by a battery.

4. A high-frequency heating apparatus as claimed in claim 1, 2 or 3, wherein a feeder line from said DC power source to said inverter power source does not have a branch line.

5. A high-frequency heating apparatus as claimed in claim 1, further comprising:

an oscillator for driving a semiconductor switching element of said inverter power source;

a control circuit for controlling said oscillator;

a heating chamber for accommodating an article to be heated, in which microwave is irradiated over the article so as to heat the article;

an oscillator switch for supplying electric power to said oscillator; and a switch operating means for effecting ON/Off operation of said oscillator switch in response to a signal of said control circuit such that said inverter power source is controlled by turning on and off said oscillator switch.

6. A high-frequency heating apparatus as claimed in claim 5, further comprising a door switch which is turned on and off by opening and closing of a door for putting the articles into or taking the articles out of said heating chamber such that supply of electric power to said oscillator is turned on and off by turning on and off said door switch.

7. A high-frequency heating apparatus as claimed in claim 6, further comprising a detection means for detecting a turning on and off of said door switch such that a signal of said detection means is transmitted to said control circuit,

8. A high-frequency heating apparatus as claimed in claim 1, further comprising:

an apparatus body including a heating chamber for heating an article to be heated, and an output controller for controlling an output of said magnetron; and an operating portion for giving an operating command to said output controller, which is detachable from said apparatus body.

9. A high-frequency heating apparatus as claimed in claim 8, wherein at least one of a reception means and a transmission means for a transmission signal of electromagnetic wave or compressional wave is provided on said operating portion and said output controller such that the operating command is transmitted and received through air.

10. A high-frequency heating apparatus as claimed in claim 8 or 9, wherein a display portion is provided on said operating portion.

11. A high-frequency heating apparatus as claimed in claim 1, wherein a mounting means for mounting said high-frequency heating apparatus on said transport device includes a magnet provided on a rear face of an operating portion and said magnet is brought into contact with a body of said transport device or a magnetic number attached to said body of said transport device such that attractive force is produced between said magnet and said body of said transport device or said magnetic member attached to said body of said transport device.

12. A high-frequency heating apparatus as claimed in claim 1, further comprising:

a heating chamber for accommodating an article; and a restraint member for positionally securing the article in said heating chamber.

13. A high-frequency heating apparatus as claimed in claim 12, wherein said restraint means is constituted by an electromagnet provided at a portion of said heating chamber and a container holding said article and provided with magnetic material partially.

14. A high-frequency heating apparatus as claimed in claim 12, wherein said restraint means is constituted by a first member and a cylindrical second member, said first member being provided on a bottom face of said heating chamber and including a recess defined by a threaded cylindrical wall, said second member including a threaded cylindrical outer wall and being fitted within said recess of said first member;

said second member including a centrally located opening for placing therein said article.

15. A high-frequency heating apparatus as claimed in claim 12, wherein said restraint means is made of non-metallic material and is detachably mounted on a side wall of said heating chamber and stored on a bottom face of said heating chamber, said restraint means being formed with a hole of a predetermined shape.

16. A high-frequency heating apparatus comprising:

a cell or a DC power source obtained by rectifying AC obtained from a dynamo;

an inverter power source for converting said DC power source into high-frequency AC;

a control circuit for controlling said inverter power source;

a magnetron which is actuated by an output of said inverter power source such that an article to be heated is heated by an output of said magnetron;

an apparatus body including a heating chamber for accommodating the article;

an acceleration detecting means for detecting acceleration applied to said apparatus body, which is incorporated into or provided on said apparatus body; and an acceleration control means which is actuated by an output of said acceleration detecting means;

wherein when the output of said acceleration detecting means becomes equal to or more than a predetermined reference acceleration value, said control circuit is operative to stop an operation of said inverter power source.

17. A high-frequency apparatus comprising:

a magnetron which is actuated by an output of an inverter power source such that an article to be heated is heated by an output of said magnetron;

a heating chamber for accommodating the article;

an apparatus body including a door for putting the article into or taking the article out of said heating chamber;

a detection means for detecting an acceleration applied to said apparatus body, which is incorporated into or provided on said apparatus body; and a fixing means for securing within said apparatus body at least one of the article and said door, which is actuated on the basis of an output of said detection means.

18. A high-frequency heating apparatus as claimed in claim 17, wherein said fixing means includes an electromagnet for securing the article or said door by magnetic force of said electromagnet.

* * * * *